United States Patent [19]

Neeser

[11] Patent Number: 4,683,921

[45] Date of Patent: Aug. 4, 1987

[54] CARBONATED BEVERAGE STORAGE AND DISPENSING SYSTEM AND METHOD

[75] Inventor: Timothy A. Neeser, Savage, Minn.

[73] Assignee: Minnesota Valley Engineering, Inc., New Prague, Minn.

[21] Appl. No.: 859,311

[22] Filed: May 5, 1986

[51] Int. Cl.[4] ..... B65B 3/04; B67C 7/00

[52] U.S. Cl. ..... 141/1; 141/9; 141/82; 141/91; 141/326

[58] Field of Search ..... 141/89, 90, 91, 92, 141/98, 82, 325, 326, 327, 1-12

[56] References Cited

U.S. PATENT DOCUMENTS 3,003,325 10/1961 Poethig et al. ..... 62/55
3,898,861 8/1975 McMillin ..... 141/82
4,553,573 11/1985 McGarrah ..... 141/98
4,641,693 2/1987 Rakucewicz ..... 141/326

*Primary Examiner*—Houston S. Bell, Jr.
*Attorney, Agent, or Firm*—Jones, Day, Reavis & Pogue

[57] ABSTRACT

An improved carbonated beverage storage and dispensing system is disclosed which employs separate tanks for carbon dioxide and syrup. Mixing occurs during dispensing. For each type of syrup there are preferably two syrup supply tanks. Each syrup tank may be selectively connected to either a syrup filling source or to a sanitizing system for cleaning the tank. This system allows one of the syrup supply tanks to be sanitized or refilled, while another supplies syrup for dispensing, thus allowing uninterrupted beverage service.

6 Claims, 2 Drawing Figures

CARBONATED BEVERAGE STORAGE AND DISPENSING SYSTEM AND METHOD

BACKGROUND OF THE INVENTION

This invention relates to systems for storing and dispensing beverages. More specifically, it relates to storage and dispensing systems that allow for bulk delivery and storage of the beverage components and provides for simplified cleaning of the system.

It is known in the prior art to have carbonated beverage storage and dispensing systems whereby gaseous carbon dioxide is mixed with syrup, and water if necessary, to produce a desired carbonated beverage. These systems are often found in restaurants, and particularly fast food establishments, where the amount of beverages served makes it uneconomical to store and dispense the beverages in individual cans or bottles. Such systems usually store the carbon dioxide in elongated cylinders and the beverage syrup in smaller containers.

Though current systems allow for the storage and dispensing of carbonated beverages, there are several disadvantages. When a carbon dioxide cylinder becomes empty, it is necessary to change to an alternate cylinder interrupting the beverage service. Additional employee effort is required to replace or refill syrup containers. Often it becomes necessary to perform these tasks when consumer demand for beverages is the greatest, thus causing service delays.

Additionally, relatively skilled employees are needed for the change out since the cylinders are under pressure and mishandling may cause an accident. Also, as with any food storage container system, steps must be taken to insure the syrup cylinders are kept clean and free from contamination, requiring still additional expenditures of employee time. With some systems, a relatively large number of cylinders may be required, thus taking up a considerable amount of flow space and making cleaning around the cylinder area relatively difficult.

It is accordingly an object of the present invention to provide a carbonated beverage storage and delivery system providing for bulk storage of carbon dioxide and beverage syrup to eliminate the need for individual cylinders, and their attendant problems.

It is a further object of the invention to provide a carbonated beverage storage and delivery system that does not require skilled labor to operate.

A further object of this invention is to provide a system that eliminates interruption of beverage dispensing to refill the supply tanks.

Another object of the invention is to provide a system which allows for the bulk delivery and storage of both carbon dioxide and beverage syrup.

Other objects and advantages of the invention will be apparent from the remaining specification.

SUMMARY OF THE INVENTION

These and other objects of the invention are obtained by providing a carbonated beverage system having a bulk storage tank for liquid carbon dioxide and, preferably, at least two bulk syrup storage tanks for each type of beverage dispensed. The carbon dioxide and syrup storage tanks are connected to a mixing valve which mixes the carbon dioxide, syrup, and water, if necessary, to dispense a properly mixed beverage. Included in the system is a sanitizing unit for periodically cleaning the syrup storage tanks as well as the filling lines. By having at least two tanks for each type of beverage syrup, syrup may be dispensed from one tank while the other tank is being cleaned or filled, insuring an uninterrupted flow of syrup for mixing and dispensing. Alternatively a single tank for syrup can be employed in which case service will be interrupted during filling and cleaning. However, the basic advantages of the invention will still be obtained.

DETAILED DESCRIPTION

Figure 1:
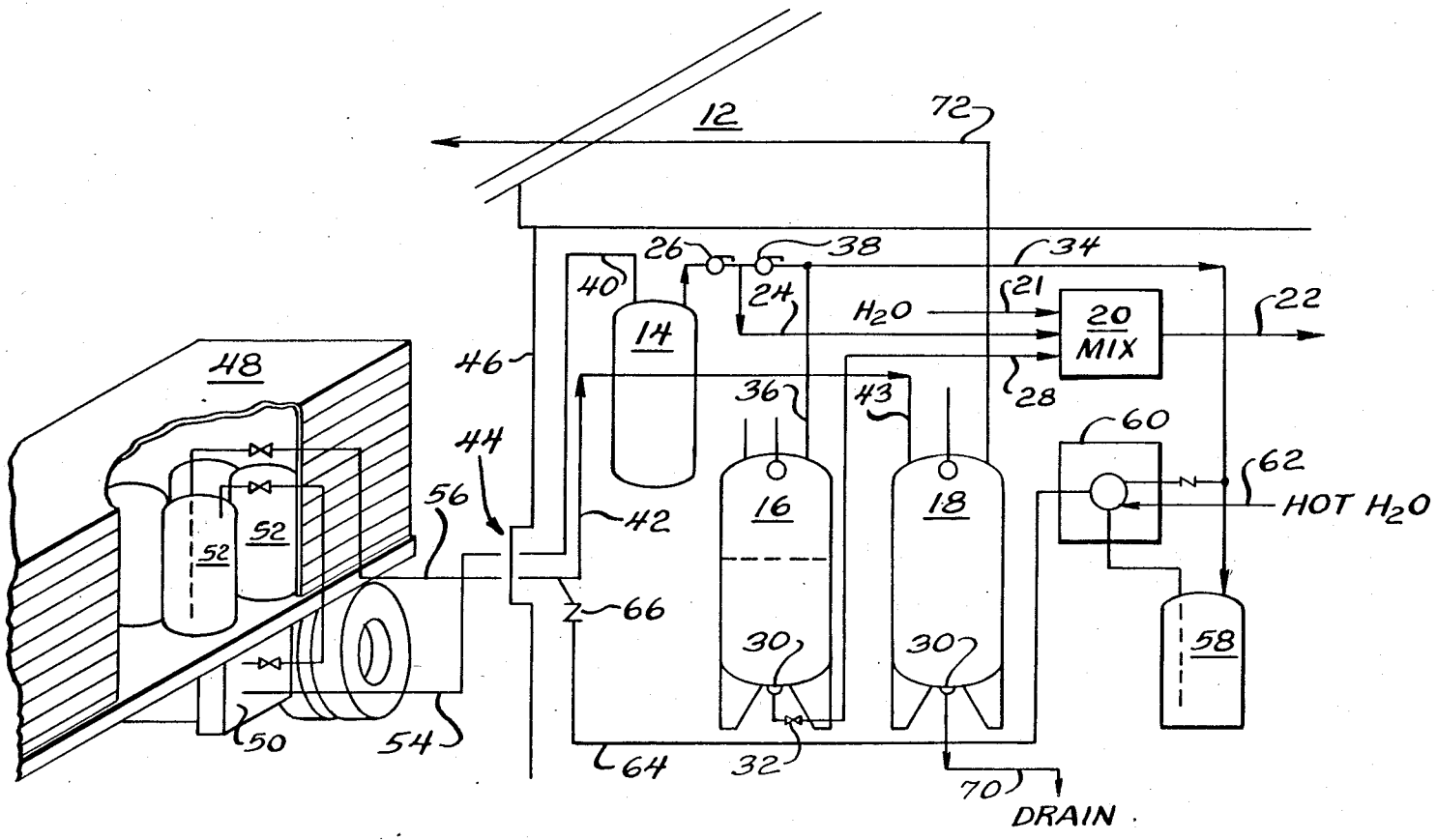
FIG. 1 is a detailed schematic illustration of the carbonated beverage storage and dispensing system of this invention, showing one syrup storage tank being filled while the other is dispensing syrup.

Referring to FIG. 1, there is illustrated a carbonated beverage storage and dispensing system 10 housed inside a restaurant 12, or other establishment. The system includes a liquid carbon dioxide tank 14 including the usual pressure building circuit which converts the liquid to a gas to maintain a selected pressure head. For each beverage to be dispensed, there are first and second syrup storage tank 16 and 18, respectively. A mixing valve 20 is provided for mixing the carbon dioxide and syrup together in appropriate quantities, and may be provided with a water input line 21 if it is necessary to add water to the final product. The final mixed beverage is then dispensed through the output line 22.

Gaseous carbon dioxide is supplied to the mixing valve 20 from the carbon dioxide tank 14 by a carbon dioxide supply line 24 having a pressure regulator 26 to insure the gas is delivered at an appropriate pressure, usually about 90 psig. A syrup supply line 28 selectively connects either the first or second syrup supply tanks 16, 18 to the mixing valve 20. Located at the bottom of each of the syrup supply tanks is a syrup supply drain valve 30 in communication with a coupling 32 for connection to line 28.

To supply the syrup to the mixing valve, pressurized carbon dioxide is supplied, via line 34, to the syrup supply tank which is dispensing, in this case tank 16. A pressure/vent coupling 36 is located at the top of each tank for that purpose. In a preferred embodiment of the invention the carbon dioxide pressure is obtained from the carbon dioxide supply line 34 and has a pressure regulator 38 to maintain the pressure at an appropriate value, usually about 60 psig.

Fill line 40, connected to the carbon dioxide tank 14, and syrup fill line 42, which can be selectively connected to either syrup supply tank coupling 43, extend from a panel 44 located in an outside wall 46 of the restaurant 12. A check valve 66 prevents the syrup from entering the sanitization line 64. This allows bulk deliveries of both liquid carbon dioxide and syrup from a source such as truck 48, having a carbon dioxide tank 50 and syrup tanks 52. A carbon dioxide fill hose 54 and a syrup fill hose 56 extending from the truck are connected by standard coupling members (details not shown) to the panel 44 for the appropriate fill line.

The system 10 also includes a sanitizing unit comprising a sanitizing solution tank 58 connected to a control panel 60 that has a hot water input 62. A sanitizing output line 64 extends from the control panel and can be selectively coupled to the syrup fill line 42, via check valve 66, located adjacent the fill control panel 44. To force sanitizing solution and the rinse water through the system the carbon dioxide pressure line 34 is connected to the sanitizing solution tank.

A drain line 70 is provided that can be selectively coupled to the drain valve 30 of one of the syrup supply tanks by attachment to either tank drain coupling 32. A vent line 72 is provided to vent the syrup tanks during filling and, for that purpose, may be selectively connected to the syrup supply tanks by pressure/vent coupling 36.

Figure 2:
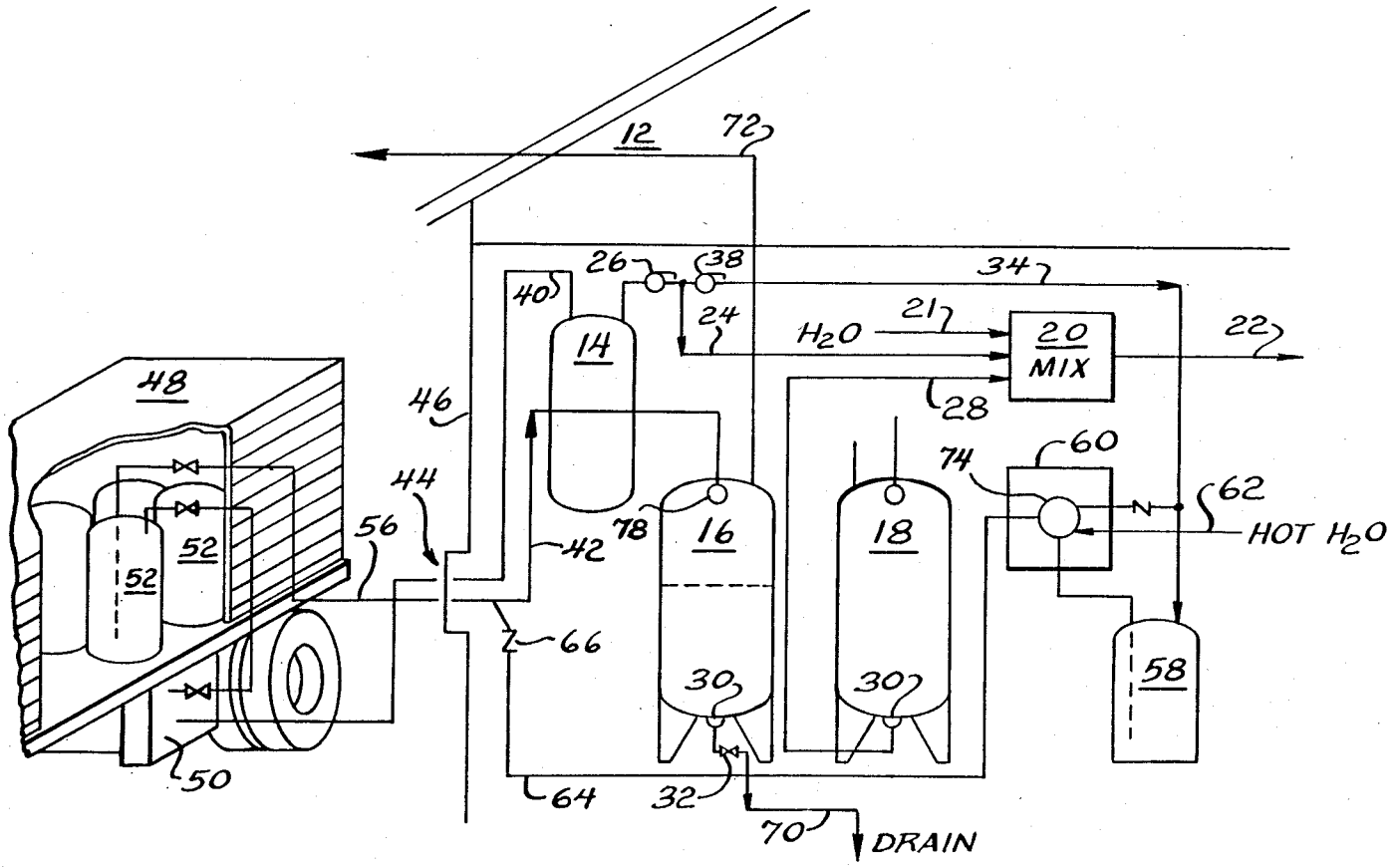
FIG. 2 is a detailed schematic illustration of the carbonated beverage storage and dispensing system of this invention showing one syrup storage tank being sanitized while the other is dispensing syrup.

FIGS. 1 and 2 illustrate how the system 10 can be continuously operated while one syrup supply tank is being refilled or cleaned. In FIG. 1 the first syrup supply tank 16 is being used as the source of syrup while the second tank 18 is being refilled. Thus, the syrup supply line 28 is connected to the tank coupling 32 of the first tank and that tank is pressurized by carbon dioxide via line 34 through pressure/vent coupling 36.

The second syrup supply tank 18 is being filled with syrup from the truck syrup tank 52 via lines 56 and 42 while the vent line 72 is attached to the pressure vent coupling 36 so the air displaced from the syrup tank can be purged. If desired, the carbon dioxide tank can simultaneously be filled from the truck carbon dioxide tank 50 via lines 54 and 40. The truck syrup tank is pressurized by the carbon dioxide tank 50 or other source.

In FIG. 2 the second syrup supply tank 18 is being used as the syrup source and the first syrup supply tank 16 is being cleaned. The syrup supply line 28 and carbon dioxide gas pressure line 34 are connected to the second syrup supply tank in the same manner as they were connected to the first syrup supply tank in FIG. 1. The switch over is accomplished manually and requires a very short time to switch the lines 28 and 34 from tank 16 to tank 18.

To sanitize the syrup supply tank 16, the output sanitizing line 64 is connected to the syrup fill line 42 via check valve 66. The drain line 70 is then connected to the first syrup supply tank drain 30 via coupling 32. During initial cleaning, the syrup fill line 42 is attached to the coupling 43 of the syrup supply tank 16. Through operation of a fluid select valve 74 on the sanitizing control panel 60, streams of sanitizing solution from tank 58, rinse water, and purging $Co_2$ from the pressure line 34, are sequentially pumped through the sanitizing line 64 to sanitize the syrup supply line 42, and the tank 16. The solution then empties through the drain line 70. Next, line 64 (or line 42) is connected to a sanitization coupling located in the top center of the supply tank 16 which communicates with a spray ball shower head 78 located inside the top of the tank. Sanitizing solution, rinse water, and purging gas are again pumped to the tank where the fluids are thoroughly dispersed against the inside walls by the spray ball, and again emptied out through the drain line. The empty, cleaned tank can then be refilled as previously described.

Valve 74, preferably, is a four position valve. In a first position, cleaning fluid from tank 58 flows into the line 64. In a second position carbon dioxide and/or air passes the valve, in a third position hot water flows to the line 64 while in the fourth position the valve is *off*. By operation of the valve the various cleaning steps just described are accomplished.

While I have shown and described embodiments of this invention in some detail, it will be understood that this description and illustrations are offered merely by way of example, and that the invention is to be limited in scope only by the appended claims.

I claim:

1. A system for storing and dispensing carbonated beverages comprising:

(a) at least two syrup supply tanks for each type of syrup to be dispensed, each tank having a drain connection at the bottom thereof and a fill connection;

(b) a source of carbon dioxide and a source of water;

(c) a mixing valve for mixing carbon dioxide, syrup and water to dispense carbonated beverages on demand;

(d) means for communicating syrup from either one of said syrup tanks, via said drain connection, to said mixing valve;

(e) means for filling the other of said syrup tanks with syrup via said fill connection, said filling means including:

(i) means for communicating said tank with a transportable syrup supply tank, (ii) means for venting the tank being filled to permit escape of air displaced by syrup;

(f) means for cleaning the filling means and the tank to be filled prior to such filling operation;

whereby one of said tanks can be cleaned and filled with syrup while the other tank supplies syrup to the mixing valve to permit substantially uninterrupted dispensing of carbonated beverages merely by switching back and forth between tanks.

2. The system according to claim 1 wherein the source of carbon dioxide is a liquid carbon dioxide supply tank and said means for filling includes means for communicating said tank with liquid carbon dioxide from a transportable carbon dioxide supply tank.

3. The system according to claim 1 wherein said cleaning means includes:

(a) a tank having a quantity of cleaning solution;

(b) means for pressurizing said tank solution;

(c) valve and conduit means for selectively communicating cleaning solution to said filling means and the tank to be cleaned.

4. The system according to claim 3 wherein said valve and conduit means are connected to hot water and carbon dioxide gas supplies and wherein said valve and conduit means includes a valve permitting the sequential transmission of cleaning solution, hot water and carbon dioxide through the filling means and the tank to be cleaned.

5. A method for storing and dispensing carbonated beverages comprising the steps of:

(a) providing at least two syrup supply tanks for each type of syrup to be dispensed, each tank having a drain connection at the bottom thereof and a fill connection near the top thereof;

(b) providing a source of carbon dioxide and a source of water;

(c) communicating syrup from one of said syrup tanks, via said drain connection, to said mixing valve for mixing carbon dioxide, syrup and water to dispense carbonated beverages on demand;

(d) filling the other of said tanks with syrup by:

(i) communicating said other tank with a transportable syrup supply tank, (ii) venting said other tank to permit escape of air displaced by syrup;

(e) cleaning the filling means and the said other tank prior to the filling operation;

whereby while one of said tanks supplies syrup to the mixing valve, the other can be filled with syrup to permit substantially uninterrupted dispensing of carbonated beverages merely by switching back and forth between tanks.

6. The method according to claim 5 wherein said cleaning step includes sequential transmission of cleaning solution, hot water and carbon dioxide through the filling means and the tank to be cleaned.

* * * * *